United States Patent [19]

Botts

[11] Patent Number: 4,755,109

[45] Date of Patent: Jul. 5, 1988

[54] SNAP-TOGETHER PERISTALTIC MECHANISM

[75] Inventor: Charles R. Botts, San Diego, Calif.

[73] Assignee: Fisher Scientific Company Inc., San Diego, Calif.

[21] Appl. No.: 34,326

[22] Filed: Apr. 3, 1987

[51] Int. Cl.[4] ..... F04B 43/12; A61M 1/00

[52] U.S. Cl. ..... 417/360; 29/156.4 R; 29/453; 29/156.5 R; 74/55; 74/569; 403/375; 403/397; 417/474

[58] Field of Search ..... 417/474, 475, 360; 29/156.4 R, 156.58, 453; 74/55, 569, 570; 403/397, 375

[56] References Cited

U.S. PATENT DOCUMENTS

| | | | |
|---|---|---|---|
| 844,414 | 3/1886 | Bloomquist . | |
| 1,922,196 | 8/1933 | Butler | 417/474 X |
| 2,412,397 | 12/1946 | Harper | 417/474 |
| 2,803,050 | 8/1957 | Fernberg | 403/397 X |
| 3,083,647 | 4/1963 | Muller | 417/474 |
| 3,199,054 | 4/1965 | Arndt et al. | 417/360 X |
| 3,610,781 | 10/1971 | Kolb | 417/319 |
| 4,184,817 | 1/1980 | Pareja | 74/55 X |
| 4,191,184 | 3/1980 | Carlisle | 128/214 F |
| 4,199,307 | 4/1980 | Jassawalla | 417/474 |
| 4,439,706 | 4/1984 | Borsanyi et al. | 604/153 |
| 4,473,342 | 9/1984 | Iles | 417/360 |
| 4,479,797 | 10/1984 | Kobayashi et al. | 604/153 |
| 4,493,706 | 1/1985 | Borsanyi et al. | 417/474 X |
| 4,617,014 | 10/1986 | Cannon et al. | 604/67 |
| 4,617,775 | 10/1986 | Padrun | 403/397 X |
| 4,653,987 | 3/1987 | Tsuji et al. | 417/360 |

*Primary Examiner*—Carlton R. Croyle
*Assistant Examiner*—Theodore Olds
*Attorney, Agent, or Firm*—Workman, Nydegger & Jensen

[57] ABSTRACT

A peristaltic pumping mechanism comprises a pump housing for holding a peristaltic drive means and adapted to support the drive motor for the peristaltic means. The mechanism further comprises a base member formed with an orifice having a periphery with a plurality of protrusions positioned therealong. The base member receives the housing in the orifice with a lip on the housing resting on the protrusions. The mechanism further comprises a cover which has an edge and a plurality of grips positioned along its edge for insertion between the periphery of the orifice and the lip of the housing to engage the grips with the base member and clampingly hold the housing and its associated peristaltic mechanism between the cover and the base member.

14 Claims, 3 Drawing Sheets

SNAP-TOGETHER PERISTALTIC MECHANISM

BACKGROUND

This invention relates generally to pumping mechanisms. More specifically, the present invention relates to a linear peristaltic pumping mechanism which can be assembled by snapping together its various components. This invention is particularly, but not exclusively, suited for the assembly of a linear peristaltic mechanism used for the infusion of medical solutions to a patient.

DESCRIPTION OF THE PRIOR ART

Peristaltic pumps have been used in the medical field for many years to infuse fluids into patients. Such use is well documented and so many examples of both rotary and linear peristaltic pumps can be cited that no such citation here is deemed necessary.

The general principles of operation for peristaltic pumps are common to all of them. In each case, the objective is to create a moving zone of occlusion along a resilient tube for the purpose of pumping fluid through the tube. The many diverse ways in which this objective is accomplished is manifested in the wide variety of types of peristaltic pumps. Indeed, the operations of the many diverse mechanisms which have been designed to function as peristaltic pumps can be the subject of considerable discussion. However, for the purposes of the present invention, such a discussion is not necessary. The present invention does not focus on the generation of the peristaltic action by the pumping mechanism. Instead, the focus here is on how peristaltic pumps can be manfuactured and assembled.

Typically, peristaltic pumps include a pumping mechanism which is an assembly of many different components made from many different materials. As is to be expected, the complexity of the interaction of these components increases with the sophistication of the pump and this, in turn, causes a corresponding increase in the difficulty of assembling the pump. In part, this difficulty is caused by the need for precise interaction of the pump's components. In part, the difficulty stems merely from the need to assemble a large number of parts. The main problem, however, at least insofar as manufacture and assembly is concerned, turns on how best to attach or connect the pump's individual components with acceptable precision.

Various techniques have been employed throughout the medical device industry for the assembly of peristaltic pumps. As is well known by those skilled in the pertinent art, such techniques include welding, bonding, gluing, and bolting to name but a few. In each case, the particular technique used will depend to some extent on required tolerances, materials used and rigidity considerations at the connection. Each of these techniques, however, require different labor skills and can be time consuming to accomplish. The problem is further compounded when several different techniques must be used to assemble each individual pump. In the past, the acceptability for the expense of manufacturing and assembling pumps using traditional techniques has been justified by the need to provide a pump which is reliable, durable and accurate.

The present invention recognizes that the beneficial attributes of reliability, durability and accuracy can still be achieved using only a snap-together method of assembly for all operative components of the pump. Unlike prior art pumps, the present invention requires only a snap-together method for assembly of the pumping mechanism components. Even though the drive motor is normally attached to the pumping mechanism by conventional screws, it too can be assembled with snap-together structure. An advantage this presents over the prior art, is that all components are designed for immediate operative assembly. There is no need to establish tolerances during assembly and there is no need for special lubrication between the parts. Further, the present invention recognizes that all snap-together components can be made of injection molded plastics. Thus, not only is the assembly simplified, the manufacture of components is greatly facilitated by the use of a single manufacturing process. Still further, it is recognized by the present invention that the interdependance of components in a snap-together construction results in a pump which can function only when all components are properly positioned. This, of course, facilitates the service and maintenance requirements.

Accordingly, it is an object of the present invention to provide a peristaltic pump whose components can be assembled in a snap-together manner. It is another object of the present invention to provide a peristaltic mechanism comprised only of components which can be injection molded. Still another object of the present invention is to provide a peristaltic mechanism which can be easily assembled with relative simplicity. Yet another object of the present invention is to provide a peristaltic mechanism which is cost effective, reliable, durable and accurate. Still another object of the present invention is to provide a peristaltic mechanism which is easily serviced and maintained.

SUMMARY OF THE INVENTION

A preferred embodiment of the novel snap-together peristaltic pumping mechanism includes a housing for holding a peristaltic drive and its associated drive motor. The housing is formed with a lip that extends along the top edge of the housing. A base member is formed with an orifice which defines a periphery along which a plurality of protrusions are located. The orifice is dimensioned to receive the pump housing in a manner which causes the lip of the housing to rest against the protrusions with a predetermined distance between the lip and the periphery of the orifice. The peristaltic drive includes a camshaft having a plurality of cam lobes arranged therealong in a helical manner for association with a respective plurality of peristaltic fingers. In its combination with the peristaltic fingers, the camshaft is rotatably mounted on the housing to establish a linear reciprocal movement of the peristaltic fingers relative to the housing. A cover having an edge along which are formed a plurality of grips snaps into engagement with the base member when the grips are inserted between the lip of the housing and the periphery of the base member's orifice. This snap-together engagement grasps the lip of the housing between the cover and the protrusions which extend along the orifice of the base member to rigidly hold the housing and its associated peristaltic drive means therebetween.

The novel features of this invention as well as the invention itself, both as to its organization and operation will be best understood from the accompanying drawings taken in conjunction with the accompanying description in which similar reference characters refer to similar parts and in which:

DESCRIPTION OF THE PREFERRED EMBODIMENT

Figure 1:
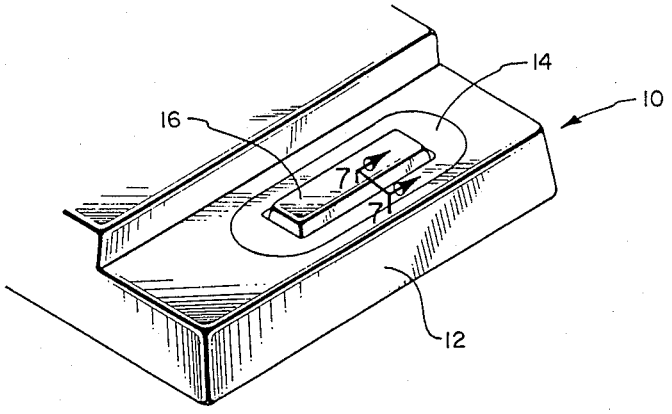
FIG. 1 is a perspective view of the present invention in its assembled configuration.

Referring initially to FIG. 1, a peristaltic pump generally designated 10 is shown in an assembled configuration. The major components of pump 10 include a base member 12 and a cover 14 which snap-together to hold a pumping mechanism therebetween in a manner to be subsequently discussed in detail.

Figure 2:
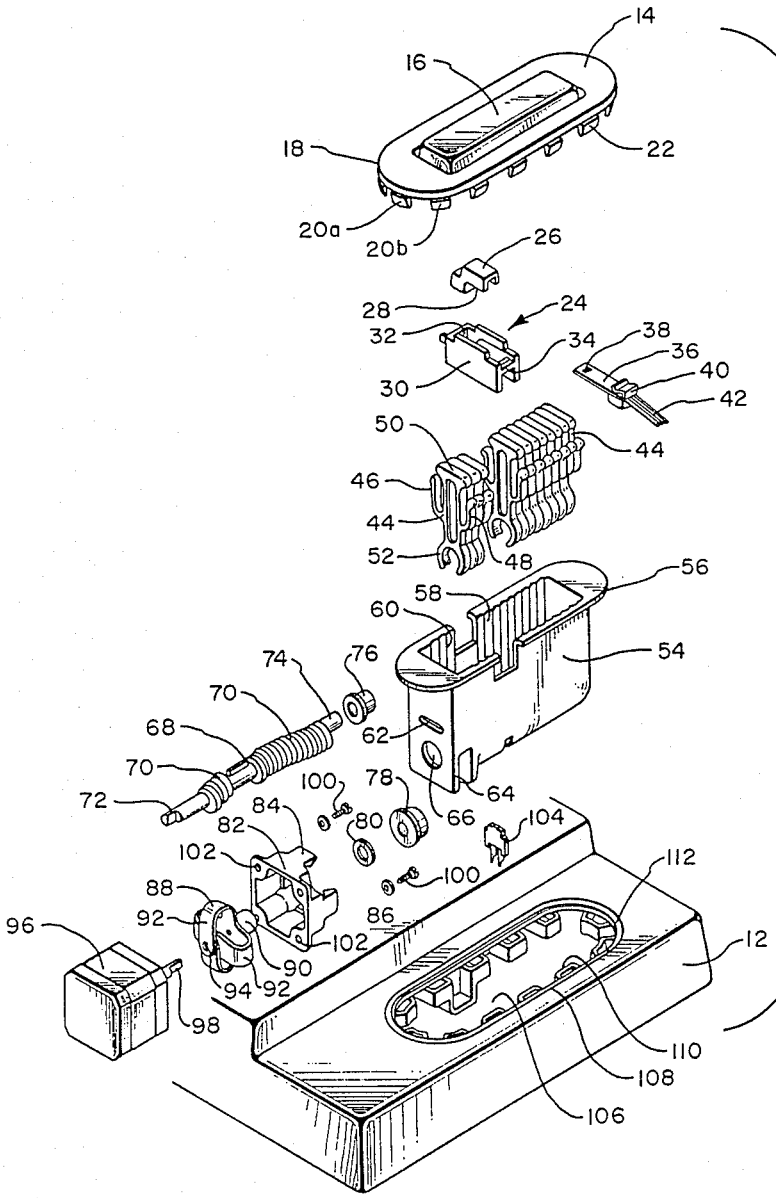
FIG. 2 is a perspective exploded view of the components of the present invention.

In FIG. 2, the various components of the linear peristaltic pump 10 are shown in detail. As seen in FIG. 2, cover 14 is formed with a membrane 16. It is to be understood that membrane 16 is integrally formed from the same material used for cover 14 in a manner well-known in the pertinent art. Specifically, using well established injection molding techniques, membrane 16 can be made with a sufficiently thin cross-sectional area to allow it to deform and be resilient for the operational purposes of pump 10 to be subsequently discussed. As shown, cover 14 defines an edge 18 along which a plurality of grips 20*a*, *b*, et. seq. are formed. As also shown in FIG. 2, but perhaps better seen in FIGS. 3, 4 and 7. The grips 20 are individually formed with a flange 22.

A strain gauge assembly generally designated 24 in FIG. 2 comprises a pressure plate 26 which is formed with an indent 28. The support 30 of strain gauge assembly 24 is formed with an opening 32 and a bar 34. Also included within the strain gauge assembly 24 is a beam 36 having a button 38 formed thereon and having a clip 40 attached at one end of the beam 36. Wiring 42 is associated with the beam 36 for purposes of transmitting electrical signals from a strain gauge (not shown) which is operatively deposited on the beam 36. Thus, flexures of beam 36 will result in signals from the strain gauge (not shown) which are indicative of movement of pressure plate 26. It will be appreciated by the skilled artesan that pressure plate 26 can be urged against a resilient tube in a manner that will cause movements of pressure plate 26 to be a proper indication of pressure in the resilient tube. In the assembly of strain gauge assembly 24 it is intended that pressure plate 26 be positioned within opening 32 of the support 30 and that clip 40 be engaged with bar 34 while button 38 is snappingly engaged within the indent 28 of pressure plate 26. In this manner, beam 36 is held within the strain gauge assembly 24 in a manner which allows the strain gauge (not shown) on beam 36 to sense movement of pressure plate 26 and use such movement as suggested above to indicate pressure differentials manifested against pressure plate 26.

Still referring to FIG. 2, it can be seen that peristaltic pump 10 of the present invention also includes a plurality of fingers 44. As shown, each finger 44 has a resilient arm 46 and a resilient arm 48. Each finger 44 also is formed with a butt 50 at one end of finger 44 and formed with a clamp 52 at the end of finger 44 opposite from butt 50.

The present invention also includes a housing 54. As seen in FIG. 2, housing 54 is formed with a lip 56 that extends around the top edge of housing 54. The inside surfaces of housing 54 are formed a series of grooves 58 which are separated by the ridges 60. As intended by the present invention, grooves 58 of housing 54 each receive a respective finger 44 and confine the finger 44 for linear reciprocal motion within the groove 58. It will be seen that housing 54 is also formed with a slot 62, a marge 64 and a hole 66.

A camshaft 68 is integrally formed with a series of cam lobes 70 arranged in a helical manner along the longitudinal axis of the camshaft 68. Camshaft 68 is also formed with a D-shaped connector 72 at the end of camshaft 68 which is opposite end 74. It will be understood by the skilled artesan that the combination camshaft 68 and lobes 70 can be made of unitary construction and, more specifically, they can be injection molded as one part. A bushing 76 receives end 74 of camshaft 68 for rotatably mounting camshaft 68 onto housing 54. A bushing 78 receives the end of camshaft 68 which is opposite from end 74 and permits D-shaped connector 72 to extend through bushing 78 and through hole 66 in a manner which will allow camshaft 68 to rotate relative to housing 54.

With camshaft 68 mounted for rotation on housing 54, the fingers 44 positioned within grooves 58 of housing 54 can be snappingly engaged with respective lobes 70 of camshaft 68. This engagement results in linear reciprocal motion of fingers 44 within the grooves 58 in response to rotation of camshaft 68. Within grooves 58 fingers 44 are positioned with resilient arms 46, 48 resting against housing 54. This allows for small rotations of a finger 44 relative to housing 54 without causing a seizure of finger 44 in housing 54 or a degradation of the desired linear reciprocal movement of finger 44. As will be appreciated by the skilled artesan this also allows for minor tolerance variations between the various components of pump 10 and allows for a more predictable peristaltic action of fingers 44. Still referring to FIG. 2, it can be seen that the present invention is provided with a washer 80 which will assist in the connection of camshaft 68 with the other operative components of the present invention.

Pump 10 also includes a bracket 82 which is formed with a plurality of grips 84. Each individual grip 84 is formed with a flange 86 which allows for the snapping engagement of bracket 82 with housing 54. More specifically, it can be seen that one of the grips 84 is positioned for gripping engagement with slot 62 and the other grips 84 grippingly engage with housing 54 in a manner shown similar to the engagement with marge 64. In a like manner, other grips 84 (not shown) snappingly engage with respective portions of housing 54 to hold the bracket 82 against housing 54.

Figure 4:
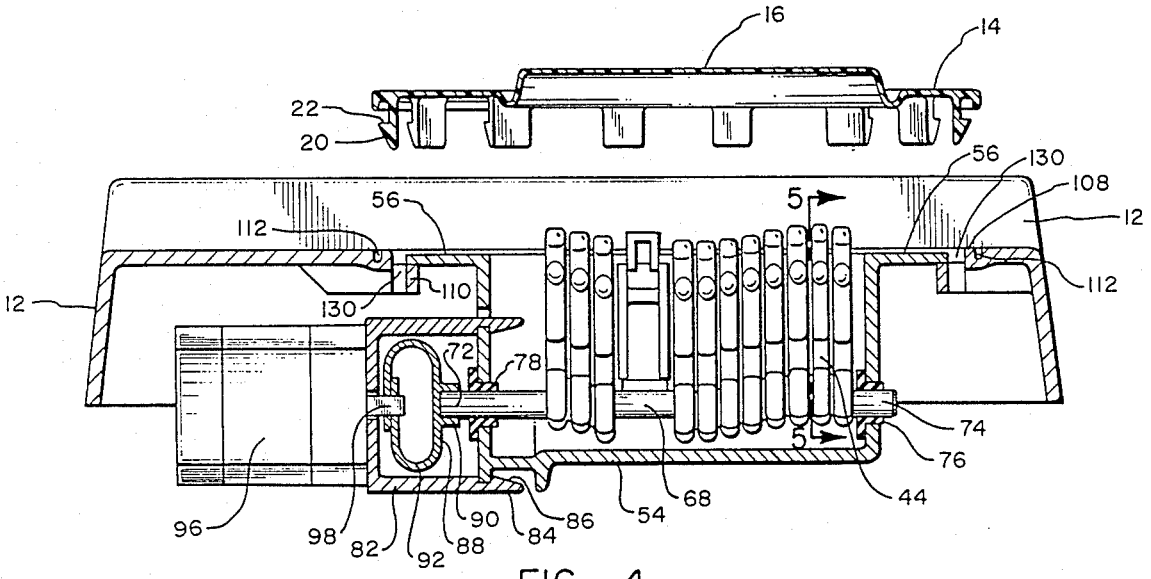
FIG. 4 is a cross-sectional view of the peristaltic mechanism as seen along the lines 4—4 in FIG. 3.

A resilient coupler 88 is formed with an extension 90 and a plurality of straps 92. Straps 92 are formed for overlapping engagement in the manner as shown in FIGS. 2 and 4 to provide for general movement between the extension 90 and a D slot 94 which is formed at the overlapping juncture of the straps 92. A motor 96 is provided with a D shaft 98 which is engageable with D slot 94.

In accordance with the present invention, once camshaft 68 is mounted onto housing 54, bracket 82 can be snapped into position against housing 54 in a manner described above. The extension 90 of resilient coupler 88 is then engaged with D connector 72 of camshaft 68. Likewise, D shaft 98 of motor 96 is engaged with D slot 94 of resilient coupler 88 and motor 96 is then fixedly bolted into position against bracket 82 by use of the bolts 100 which are inserted through the holes 102 of bracket 82 for engagement with motor 96. A pressure member 104 is shown which is operatively engageable with strain gauge assembly 24 for the purpose of providing an indication of the pressure differentials perceived by strain gauge assembly 24.

FIG. 2 also shows that base member 12 is formed with an orifice 106. Further, FIG. 2 shows that orifice 106 is defined by a periphery 108 on cover 12 which has a plurality of protrusions 110 extending inwardly from the periphery 108 into orifice 106. Also, an indentation 112 is formed at the periphery 108 of orifice 106.

Figure 3:
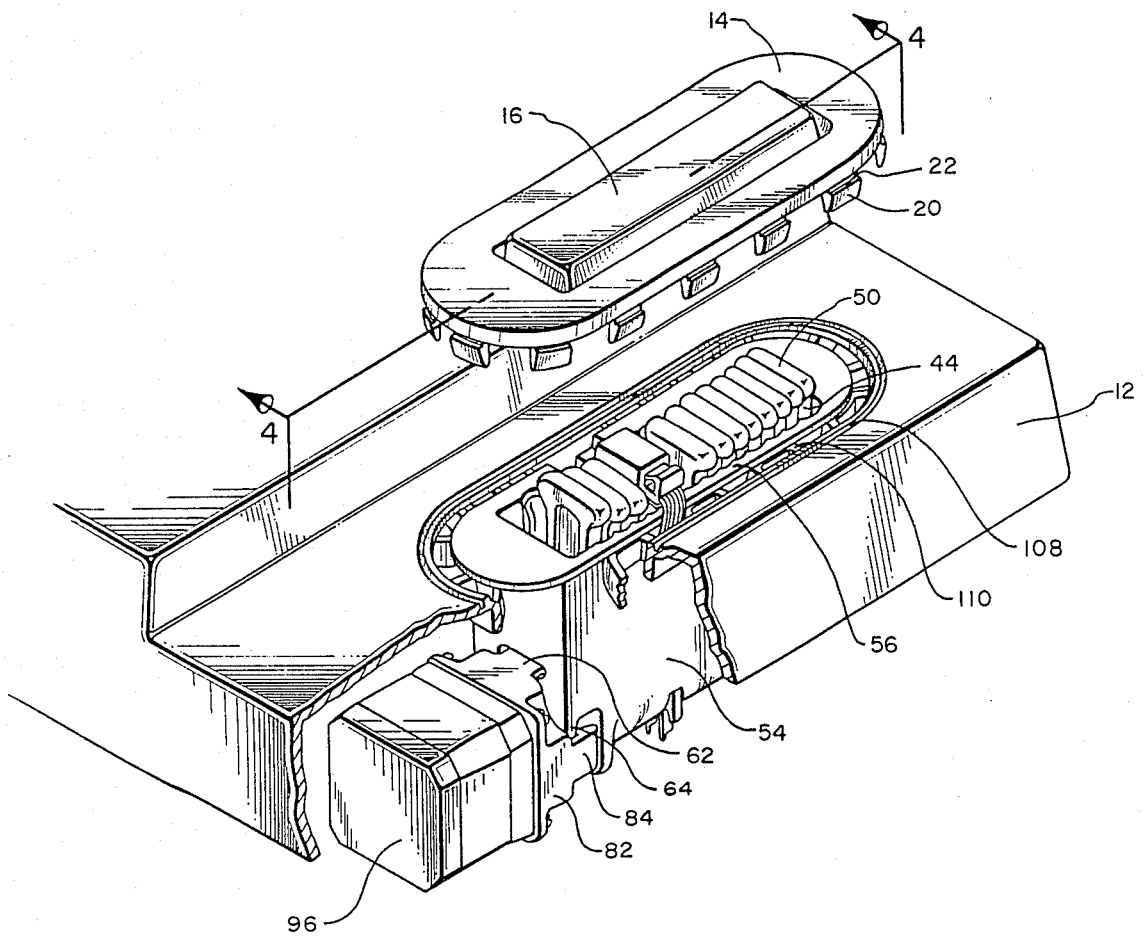
FIG. 3 is a perspective view of the peristaltic drive mechanism and associated motor with portions broken away and shown in exploded relationship for clarity.

Further appreciation of the interaction of components for the present invention can be had by reference to FIGS. 3 and 4 wherein the interaction of specific components is shown in greater detail. Specifically, in FIG. 3, it can be seen that housing 54 is received into base member 12 in a manner which causes lip 56 of housing 54 to rest against the protrusions 110 which extend from periphery 108 of the base member 12. Additionally, it can be seen that motor 96 in combination with bracket 82 can be snappingly engaged with housing 54. More particularly, grips 84 of bracket 82 engage with marges 64 and slot 62 formed on housing 54 for the purpose of holding bracket 82 against the housing 54. FIG. 3 also shows that fingers 44 are disposed within the housing 54 in a manner which places butt 50 of fingers 44 in position for urging against membrane 16 of cover 14 once cover 14 is snappingly engaged with base member 12.

FIG. 4 shows the cooperative interaction of the various components that make up the drive train of the pump 10. Specifically, it can be seen in FIG. 4 that motor 96 is fixedly attached to bracket 82 in a manner which allows the positioning of D shaft 98 in operative engagement with D slot 94 on straps 92 of resilient coupler 88. FIG. 4 also shows that extension 90 of resilient coupler 88 is operatively engaged wtih the D connector 72 of camshaft 68 and that camshaft 68 is mounted at its opposite ends by bushings 76 and 78 for rotation with respect to housing 54. Thus, motor 96, through its interconnection with resilient connector 88, rotates camshaft 68 and causes lobes 70 to interact with fingers 44 for the generation of a peristaltic movement of fingers 44.

Figure 5:
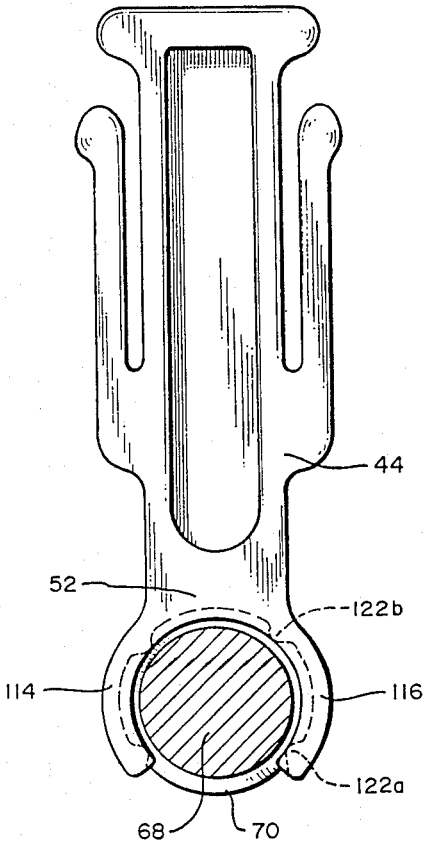
FIG. 5 is an elevational view of a peristaltic finger in its association with the camshaft as seen along the line 5—5 in FIG. 4.
Figure 6:
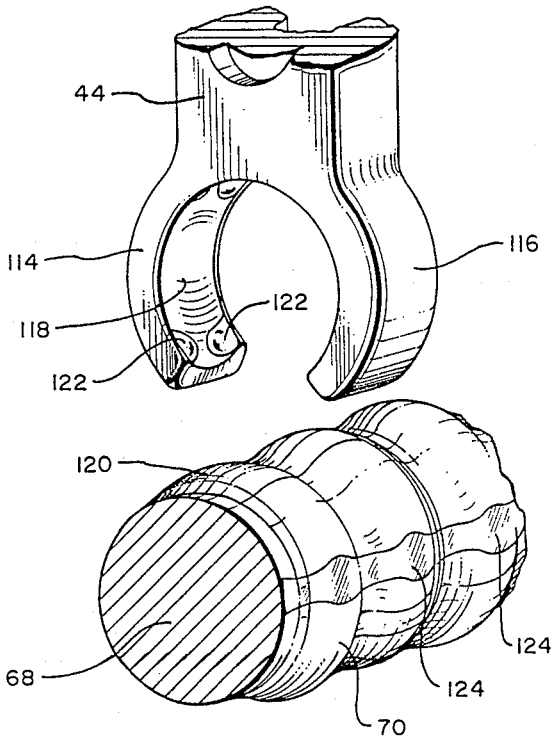
FIG. 6 is a perspective view of a portion of the peristaltic finger in relationship with a portion of the camshaft.

The interaction of fingers 44 with camshaft 68 can be best seen by cross referencing FIGS. 5 and 6. Specifically, in FIG. 5 it can be seen that the clamp 52 of finger 44 comprises a clutch 114 and a clutch 116 which are formed for operative engagement with the lobes 70 of camshaft 68. In FIG. 6 it can be seen that clutch 114 is formed with a concave surface 118 on which are formed a plurality of bumps 122. Although not completely seen in FIG. 6, it is understood that concave surface 118 continues around clamp 52 and extends along clutch 116 in a manner similar to that shown for clutch 114. It is seen in FIG. 5 that upon engagement of clamp 52 with a lobe 70 of camshaft 68 that bumps 122, not concave surface 118, ride on convex surface 120 of lobe 70. It will be appreciated by the skilled artesan that, though they are not in direct contact, concave surface 118 is compatible with convex surface 120. Instead, the actual contact between clamp 52 and camshaft 68 is accomplished by the bumps 122 which ride along the convex surface 120 of camshaft 68. This cooperation of structure provides a significant advantage for the present invention. Specifically, with the series of bumps 122 arranged on concave surface 118 of clamp 52 in the manner generally shown in FIGS. 5 and 6, it can be seen that the connection of finger 44 with camshaft 68 is accomplished at a series of points. This allows for an injection molding manufacture of the camshaft 68 and because at least a majority of the bumps 122 will ride along on lobe 70 at any given time and do so over more than 180° of the arch of lobe 70, any discontinuities in the camshaft 68 which result from the injection molding process are eliminated. For example, the flashing line 124 shown on lobe 70 in FIG. 6 may result from the injection molding process. With the cooperation of structure disclosed for the present invention, flashing line 124 is of no concern. Further, it will be appreciated by the skilled artisan that this particular structure does not impair the general action required between camshaft 68 and fingers 44 for the generation of a peristaltic action.

Figure 7:
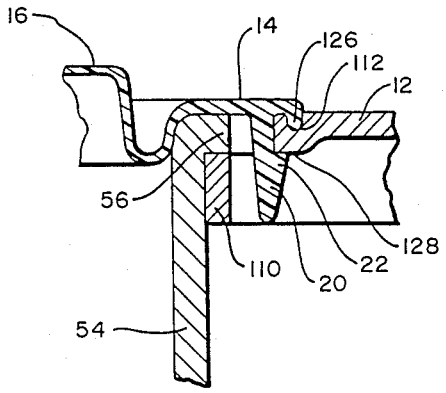
FIG. 7 is a cross-sectional view of the interaction of selected components of the present invention as seen along the line 7—7 in FIG. 1.

The snap-together capabilities for the major components of the present invention can be best understood with reference to FIG. 7 wherein the assembled interaction of base member 12, cover 14 and housing 54 can be seen. The interaction of these components as shown in FIG. 7 can perhaps be better appreciated by referring back to FIG. 3 wherein it is seen that housing 54 is positioned with respect to base member 12 in a manner which rests lip 56 of housing 54 on protrusions 110 located along periphery 108 of orifice 106. Once housing 54 is so positioned, the interaction of cover 14 with respect to base member 12 can be best seen with reference to FIG. 4. In FIG. 4 it is again seen that lip 56 of housing 54 rests on protrusions 110. Not only does this support housing 54 relative to the base member 12, it also establishes an aperture 130 between lip 56 and the periphery 108. This aperture 130 is of sufficient dimension to allow the grips 20 of cover 14 to be inserted therethrough. This causes a snapping engagement of the cover 14 with the base member 12 which results when the flanges 22 of grips 20 are positioned against the region 128 of base member 12 in a manner as best seen in FIG. 7.

Referring to FIG. 7, it will be seen that with grip 20 snapped into position against housing 12 the connection between cover 14 and base member 12 is further stabilized by the insertion of projection 126 into indention 112. It can be further appreciated that once cover 14 has been snappingly engaged with the base member 12 the housing 54 is confined between cover 12 and protrusion 110 of base member 12.

OPERATION AND ASSEMBLY

In the assembly of the peristaltic pump 10 of the present invention, camshaft 68 is operatively mounted on housing 54. This is accomplished by positioning bushing 76 with respect to housing 54 in a manner as shown in FIG. 4 and inserting end 74 of camshaft 68 into bushing 76. The end of camshaft 68 which is opposite end 74 is operatively associated with bushing 74 and extended through hole 66 on housing 54. In this manner camshaft 68 is rotatingly mounted onto housing 54.

Fingers 44 are positioned within the grooves 58 of housing 54 and snapped into position with respect to camshaft 68 in a manner which allows for operative engagement of the clamps 52 with lobes 70. The helical arrangement of lobes 70 along camshaft 68 cause a sequential linear reciprocal movement of the respective finger 44 relative to housing 54 whenever camshaft 68 is rotated. As is well known by the skilled artesan this creates a peristaltic action of fingers 44. With camshaft 68 mounted for rotation on housing 54, bracket 82 can be snappingly engaged with housing 54 and extension 90 from resilient coupler 88 can be brought into operative engagement with D connector 72 of camshaft 68. Motor 96 can then be bolted to bracket 82 to bring D shaft 98 into engagement with D slot 94 of resilient coupler 88. Motor 96 is thereby operatively connected with camshaft 68 through resilient member 88 to rotate camshaft 68 and generate a peristaltic action as previously discussed.

The entire combination of housing 54, camshaft 68 and motor 96 is now placed within orifice 106 of base member 12 in a manner which will cause lip 56 of housing 54 to rest against the protrusions 110 which extend from the periphery 108 of orifice 106 in base member 12. This particular resting relationship between housing 54 and base member 12 is best seen with reference to FIG. 3. With housing 54 so positioned, cover 14 can be snappingly engaged with base member 12 by inserting the grips 20 of cover 14 through the aperture 130 which is established between lip 56 and periphery 108. The snapping engagement of cover 14 with housing 12 brings grips 20 into contact with base member 12 in a manner as shown in FIG. 7. In this combination, the peristaltic fingers 44 are able to move in a manner well known in the pertinent art such that butts 50 of fingers 44 can urge against membrane 16 for creation of the peristaltic action. Then, as is well known by the skilled artesan, a resilient tube (not shown) placed against membrane 16, and appropriately positioned against a platen (not shown), is capable of having a peristaltic motion created along the length of the resilient tube by the pump 10 that is capable of pumping fluids therethrough.

While the particular snap-together peristaltic means and the method for assembly as herein shown and described in detail is fully capable of obtaining the objects and providing the advantages hereinbefore stated. It is to be understood that it is merely illustrative of the presently preferred embodiments of the invention and that no limitations are intended to the details of construction or design herein shown other than as described in the appended claims.

I claim:

1. An assembly for a peristaltic mechanism which comprises:

a housing;

a base member formed with an orifice for receiving said housing therein;

a plurality of peristaltic fingers, each of said fingers being formed with a pair of clutches having concave surfaces;

a drive shaft rotatably mounted on said housing, said drive shaft having a plurality of integral cam lobes, each of said lobes having a convex surface for mating engagement with said clutches;

a motor;

a resilient connector having a first slot for keyed engagement with said drive shaft and having a second slot for keyed engagement with said motor; and a cover snappingly engageable with said base member to rigidly hold said housing between said base member and said cover.

2. An assembly as recited in claim 1 further comprising means formed on said housing for confining movement of said fingers to reciprocal linear movement relative to said housing.

3. An assembly as recited in claim 2 further comprising a mount snappingly engageable to said housing, said mount having means to rigidly attach said motor thereto.

4. An assembly as recited in claim 3 wherein said housing is formed with a lip and said base member is formed with a plurality of protrusions positioned along the periphery of said orifice and extending therefrom to support said housing with said lip resting on said protrusions at a predetermined distance from said periphery.

5. An assembly as recited in claim 4 wherein said cover is formed with a plurality of grips at its edge which grips are insertable between said lip and said periphery to grasp said base member and hold said lip of said housing between said cover and said protrusions.

6. An assembly as recited in claim 5 further comprising an IV tube positioned against said peristaltic mechanism for creating a moving zone of occlusion along said tube and wherein said cover is integrally formed with a resilient member, said membrane separating said tube from said fingers of said peristaltic mechanism.

7. An assembly as recited in claim 6 further comprising a plurality of bumps formed on the concave surface of said clutches to ride on the convex surface of said respective cam lobes.

8. A peristaltic pumping mechanism comprising:

a pump housing, said housing formed with a lip;

a drive shaft rotatably mounted on said housing, said shaft having a plurality of cam lobes with convex surfaces integrally formed therealong;

a motor;

a resilient connector having a first slot for keyed engagement with said drive shaft and having a second slot for keyed engagement with said motor;

a plurality of fingers, each formed with a plurality of clutches having concave surfaces for mating engagement wtih said clutches;

a base member formed with an orifice to define a periphery and having a plurality of protrusions positioned along the periphery of said orifice and extending therefrom to support said housing with said lip resting on said protrusions at a predetermined distance from said periphery; and a cover having an edge and formed with a plurality of grips along said edge which grips are insertable between said lip and said periphery to grasp said base member and hold said lip of said housing between said cover and said protrusions of said base member.

9. A mechanism as recited in claim 8 further comprising means formed on said housing for confining movement of said fingers to reciprocal linear movement relative to said housing.

10. A mechanism as recited in claim 4 further comprising a mount snappingly engageable to said housing and having means to rigidly attach said motor thereto.

11. A mechanism as recited in claim 10 further comprising an IV tube positioned against said peristaltic pumping mechanism for creating a moving zone of occlusion along said tube and wherein said cover is integrally formed with a resilient membrane, said membrane separating said tube from said fingers of each peristaltic mechanism.

12. A mechanism as recited in claim 11 further comprising a plurality of bumps formed on the concave surface of said clutches to ride on the convex surface of said respective cam lobes.

13. A method for assembling a peristaltic pump comprising the steps of:

(a) mounting a cam shaft having a plurality of cam lobes with convex surfaces integrally formed therealong for rotation on a housing having a lip;

(b) engaging a plurality of fingers, each of said fingers being formed with a pair of clutches having concave surfaces for mating engagement with said lobes of said drive shaft;

(c) providing a resilient connector having a first slot for keyed engagement with said cam drive shaft and having a second slot for keyed engagement with a drive means for joining said cam shaft with said drive means;

(d) snapping said drive means onto said housing;

(e) confining said fingers for linear reciprocal movement relative to said housing;

(f) positioning said housing on a base member having an orifice with said lip resting on protrusions extending from the periphery of said orifice to establish a predetermined distance between said lip and the periphery of said orifice; and (g) inserting grips on the edge of a cover between the periphery of said orifice and said lip to snap said cover onto said base member and hold said housing therebetween.

14. A method as recited in claim 13 further comprising the step of positioning an IV tube against said cover for operative engagement with said fingers to create a moving zone of occlusion along said tube.

* * * * *